US006712341B1

(12) United States Patent
Mathis et al.

(10) Patent No.: US 6,712,341 B1
(45) Date of Patent: Mar. 30, 2004

(54) WATER AERATOR APPARATUS

(76) Inventors: Teri H. Mathis, 1010 Baker Rd., Rosenberg, TX (US) 77471; Lee F. Mathis, 1010 Baker Rd., Rosenberg, TX (US) 77471

( * ) Notice: Subject to any disclaimer, the term of this patent is extended or adjusted under 35 U.S.C. 154(b) by 0 days.

(21) Appl. No.: 10/122,983

(22) Filed: Apr. 16, 2002

(51) Int. Cl.[7] ..... B01F 3/04
(52) U.S. Cl. ..... 261/64.1; 261/74; 261/122.1
(58) Field of Search ..... 261/64.1, 72.1, 261/74, 122.1, DIG. 7, 72

(56) References Cited

U.S. PATENT DOCUMENTS 1,281,816 A * 10/1918 Nordell
1,912,439 A * 6/1933 Feller
2,447,716 A * 8/1948 Rowe
2,663,115 A * 12/1953 McKissack
3,578,295 A * 5/1971 Hudson
3,970,731 A * 7/1976 Oksman
4,025,590 A * 5/1977 Igich
4,367,182 A * 1/1983 Kienholz
4,776,127 A * 10/1988 Jackson
4,976,894 A * 12/1990 Robinson
6,561,382 B2 * 5/2003 Shelton

* cited by examiner

*Primary Examiner*—Scott Bushey
(74) *Attorney, Agent, or Firm*—Harrison & Egbert

(57) ABSTRACT

A water aerator apparatus having a base with a receptacle area, an aerator having an effluent port opening from the base, a container removably received within the receptacle area of the base, and an air delivery channel formed on an interior of the container. The container has an effluent port opening at a bottom of the container. The effluent port is cooperative with the influent port. The air delivery channel communicates with the influent port such that air from the aerator passes into the air channel through the influent and effluent ports. A mesh screen is positioned directly over the air delivery channel with the container.

17 Claims, 3 Drawing Sheets

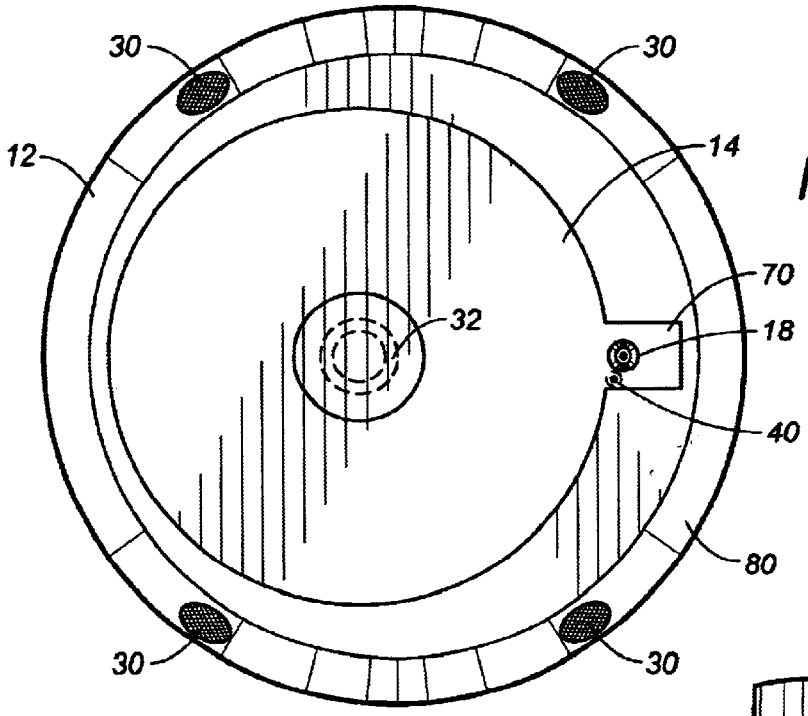
FIG.4
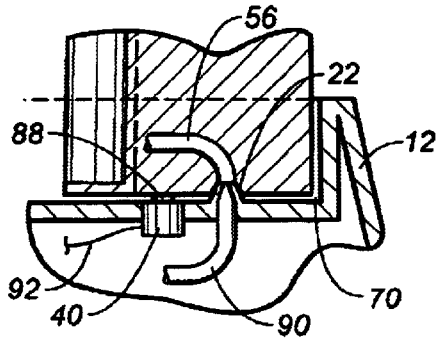
FIG.6
FIG.5
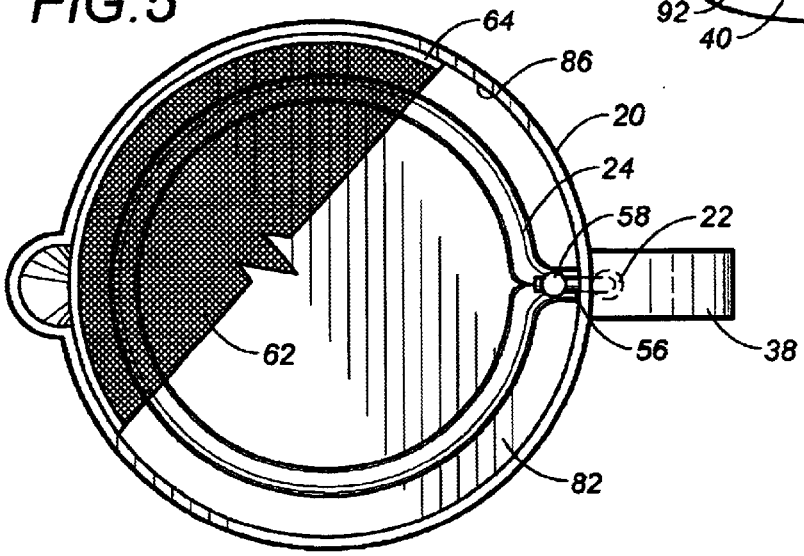

WATER AERATOR APPARATUS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to devices for aerating water. More particularly, the present invention relates to household water aerator devices wherein consumable water is oxygenated from air passing in the form of bubbles therethrough.

2. Description of Prior Art

The demand for water treatment systems is increasing. As population increases, the demand for water also increases. In many areas, clean drinking water may not be readily available. When a population moves from a well-established city with a water system to more remote areas, small scale importable water treatment becomes even more important. If the water treatment can remove the danger of contaminants and also add heathy components, then a double benefit is obtained from such a treatment.

One known water treatment method is to add oxygen to the water. Some systems bubble gas containing oxygen through the water so that some of it is retained in the water. This has been shown effective from some types of water treatment that is somewhat expensive and is a slow treatment technique. Another known technique to place oxygen in water is electrolysis, which operates as follows. A voltage is supplied from an electrolytic cell that is immersed in the water. The current flow in the water causes the water molecules to break up into their component parts of oxygen and hydrogen. Hydrogen gas and oxygen gas are thereby freed from the water. Typically, most of the hydrogen gas escapes as a gas from the water, while some of the oxygen gas is dissolved in the water. Unfortunately, such electrolysis devices are both expensive and rather ineffective in introducing oxygen into small quantities of water, such as those utilized in the household environment. Also, there is a possibility of danger because of the imminent relationship of the electrical systems in contact with water systems.

In the past, various patents have issued on water purification and oxygenation systems. For example, U.S. Pat. No. 4,061,556, issued on Dec. 6, 1977 to Rice et al., describes a portable electrolytic apparatus for providing drinking water. The housing includes a receiving chamber and an electrolytic cell. The chamber, the cell and the conduits associated therewith define a continuous path of liquid flow from the filling to the discharge aperture. Two electrodes, offset from the flow path in the cell in opposite, transverse directions, are supplied with direct current for passage of the current in the cell for the fluid flowing therethrough.

U.S. Pat. No. 4,107,021, issued on Aug. 15, 1978 to T. Okazakai, teaches a water pot with an electrolyzing device. The pot body includes an electrolyzing vessel divided into two chambers by porous partition. The chambers have negative and positive electrodes, respectively, connected thereto.

U.S. Pat. No. 4,119,520, issued on Oct. 10, 1978 to Paschakarnis et al., describes a water purification unit including an electrolytic cell adapted to hold a body of water to be purified and provided with two electrically insulated electrodes. A pump supplies the water between the electrically insulated electrodes so as to drive purified water out of the unit. A power supply is provided for supplying electrolyzing current to the electrodes.

U.S. Pat. No. 4,481,096, issued on Nov. 6, 1984 to T. Okazaki, describes another type of pot-type water purifier with an electrolyzer. The electrolyzing vessel therein is divided into two chambers. The chambers each contain negative and positive electrodes. The electrodes are suitably charged for the purpose of purifying the water.

U.S. Pat. No. 5,555,735, issued on Sep. 17, 1996 to R. H. Elliott Jr., describes a system for the removal of volatile organic pollutants from drinking water. This device includes an air pump with a hose connected thereto. The hose can extend downwardly into the interior of the container so that air bubbles will bubble upwardly through the liquid within the container.

U.S. Pat. No. 5,775,587, issued on Jul. 7, 1998 to R. A. Davis, teaches a portable, handheld drinking water fountain. This device is suitable for attaching to the aerator associated with the faucet of a standard water faucet The aerated water from the water faucet passes into a chamber and outwardly therefrom as a laminar fountain. The system redirects the downward flow of water into a controlled stream of water which acts as a sanitary drinking fountain.

U.S. Pat. No. 6,296,756, issued on Oct. 2, 2001 to Hough et al., teaches a portable water purification system, including a portable electrolytic cell for increasing the content of oxygen in the water. The electrolytic cell includes a housing and a set of electrodes. A system control circuit converts an external source of power to a direct current voltage to energize the electroletic cell. The electrolytic cell is mounted to the bottom of the container.

Each of these prior art devices teach techniques for the purification of water. However, experiments with the present invention reveal that there is another feature associated with the oxygenating of water which is of health benefit. It is believed that the level of blood oxygen is very important for health. Since arterial blood moves blood oxygen to the outer parts of the body, the greater quantity of oxygen within the blood will allow such oxygen to reach the outer parts of the body. By providing drinking water with a high percentage of oxygen therein, it is believed that the blood oxygen of persons consuming such highly oxygenated water will improve. Ideally, a person should desire 98%–99% saturation of the blood with blood oxygen. Under certain circumstances, it is possible that cancer can be caused by a lack of oxygen in the blood. For example, smokers will typically have a very low level of blood oxygen. By improving the oxygen content of water consumed by the person, it is believed that the blood oxygen levels will increase. Likewise, the health of the person consuming oxygenated water will improve.

It is an object of the present invention to provide an aerator apparatus which increases the oxygen content of consumable water.

It is another object of the present invention to provide an aerator apparatus which automatically aerates a container of drinking water upon placement upon a base.

It is another object of the present invention to provide a water aerator apparatus which maximizes the distribution of air, and its associated dissolvable oxygen throughout the water in the container.

It is a further object of the present invention to provide a water aerator apparatus which distributes the air fully and thoroughly throughout the entire container.

It is a further object of the present invention to provide a water aerator apparatus which is easy to use, relatively inexpensive and easy to manufacture.

These and other objects and advantages of the present invention will become apparent from a reading of the attached specification and appended claims.

BRIEF SUMMARY OF THE INVENTION

The present invention is a water aerator apparatus comprising a base having a receptacle area formed therein, an aerator having an effluent port at the base, a container removably received within the receptacle area of the base, and an air delivery channel formed on an interior of the container. The container has an influent port opening at the bottom of the container. The influent port is cooperative with the effluent port. The air delivery channel communicates with the influent port such that air from the aerator passes into the air delivery channel through the effluent port and the influent port.

In the preferred embodiment of the present invention, a screen is positioned directly over the air delivery channel. This screen serves to pass air therethrough having a bubble size of approximately 50–100 microns. The screen is hydrophobic such that air passes upwardly therethrough and water is prevented from passing downwardly therethrough. The screen is a stainless steel mesh screen having a frame extending around a periphery thereof. This frame is engaged with a wall of the container. The air delivery channel has a U-shaped cross-section with an open surface facing upwardly in the container. The mesh screen is positioned directly upon the open surface of the air delivery channel. The air delivery channel extends in a generally circular pattern adjacent to a bottom of the container.

The container is a pitcher with a handle extending outwardly therefrom. This handle has a bottom. The influent port opens at the bottom of the handle. The receptacle area in the base has a slotted area extending radially outwardly therefrom. The effluent port opens in this slotted area The bottom of the handle is removably received in the slotted area. The influent port has a funnel-shaped opening formed at the bottom of the handle. The funnel-shaped opening is wide at the bottom of the handle. The influent port has an air passageway extending through the handle to the air delivery channel. The effluent port includes a nozzle having an opening extending upwardly from the slotted area. The nozzle fits into the funnel-shaped opening. The effluent port will have an air passageway extending from the aerator. A switch is mounted in the slotted area for actuating the aerator when the pitcher is positioned in the receptacle area. Specifically, the switch is a button-activated switch which depresses when the bottom of the handle is placed on the button of the switch. This switch is electrically connected to the power source.

In one embodiment of the present invention, a light is affixed to the base generally centrally of the receptacle area. The light serves to illuminate an interior of the container.

The receptacle area is a circular area formed in a top surface of the base. This circular area has a size and shape corresponding to a size and shape of the bottom of the container. The circular area also includes a downwardly extending lip formed therefrom. This lip is at an opposite side of the circular area from the slotted area. The base also has a frustoconical shape with a wide diameter portion at a bottom thereof and a narrow diameter portion at a top thereof. The receptacle area is formed in the top of the base. The base also has vents formed in a wall thereof so as to open and allow air from the exterior of the base to pass to the aerator.

A first check valve is positioned between the influent port and the air delivery channel so as to prevent liquid from passing outwardly of the influent port. A second check valve is positioned between the effluent port and the aerator for preventing liquid from passing into the aerator from the effluent port.

BRIEF DESCRIPTION OF THE SEVERAL VIEWS OF THE DRAWINGS

FIG. 4 is a plan view of the base of the water aerator apparatus of the present invention.

FIG. 5 is a plan view of the container of the water aerator apparatus of the present invention.

FIG. 6 is a closeup illustration of the influent and effluent ports associated with the water aerator apparatus of the present invention.

DETAILED DESCRIPTION OF THE INVENTION

Figure 1:
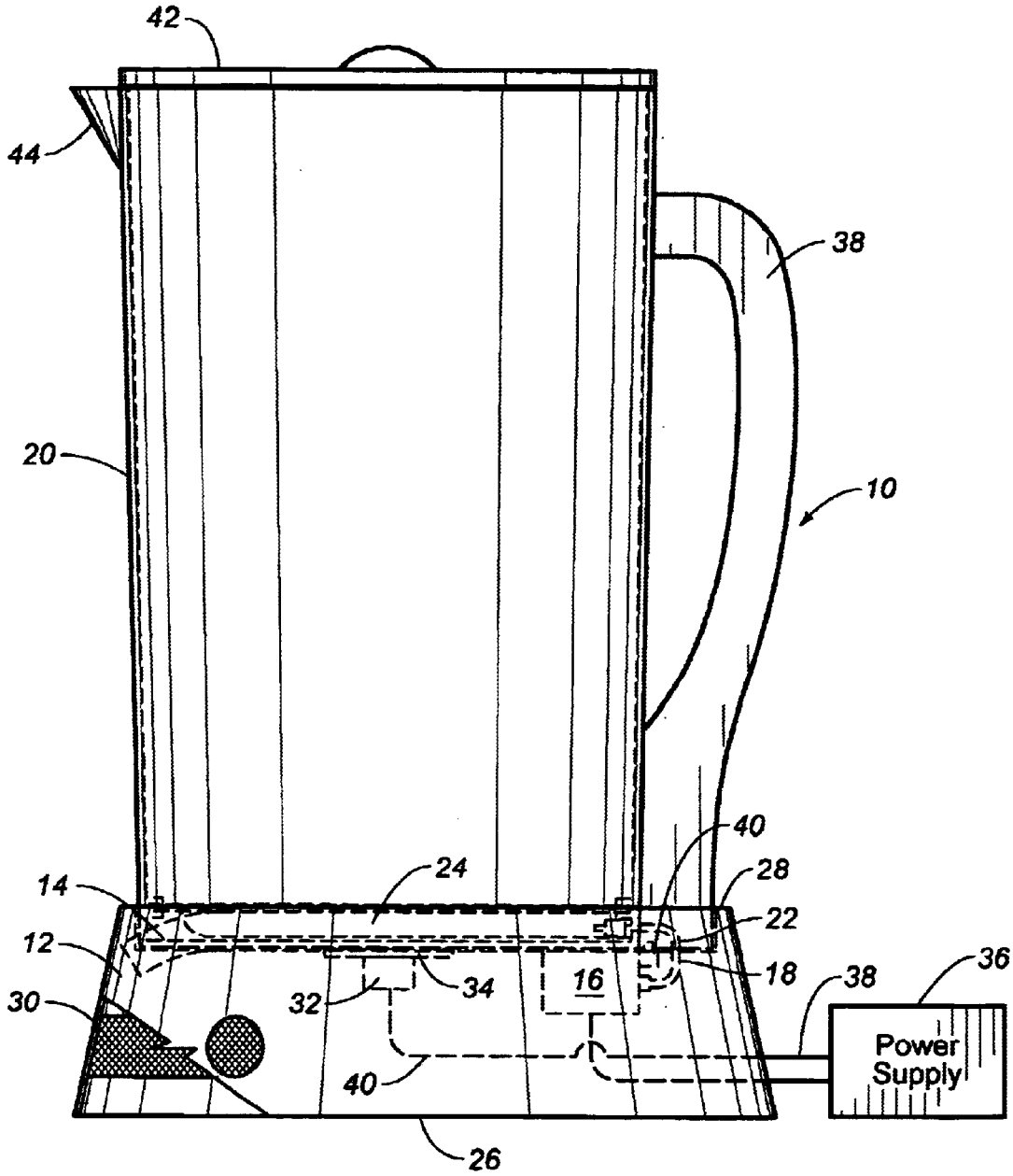
FIG. 1 is a side elevational view of the water aerator apparatus of the present invention.

Referring to FIG. 1, there is shown the water aerator apparatus 10 in accordance with the teachings of the present invention. The water aerator apparatus 10 includes a base 12 having a receptacle area 14 formed therein. An aerator 16 is affixed to the base 12. The aerator 16 has an effluent port 18 opening from the base. A container 20 is removably received in the receptacle area 14 of the base 12. The base 12 has an influent port 22 opening at the bottom of the container 20. The influent port 22 is cooperative with the effluent port 18. An air delivery channel 24 is formed on the interior of the container 20. The air delivery channel 24 communicates with the influent port 22 such that air from the aerator 16 passes into the air delivery channel 24 through the effluent port 18 and the influent port 22. Air from the aerator 16 will pass through the air delivery channel 24 so that air will bubble up through a liquid within the interior of the container 20 for the purpose of maximizing dissolved oxygen within the liquid in the container 20.

In FIG. 1, it can be seen that the base 12 has a generally frustoconical configuration with a wide diameter at the bottom 26 and a narrow diameter at the top 28. This frustoconical configuration will maximize the stability of the base upon any flat surface, such as a kitchen counter top. A vent 30 is formed in the wall of the base 12 so as to allow air to pass therethrough into the interior of the base 12 so that the aerator 16 can be suitably supplied with ambient air. A light 32 is mounted adjacent to the receptacle area 14 of the base 12. Light 32 will be generally positioned centrally of the receptacle area 14 so as to illuminate the interior of the container 20 when the container 20 is placed within the receptacle 14. A mounting bracket 34 can be used so as to secure the light 32 in its desired position. A power supply 36 is electrically connected by lines 38 and 40 to the aerator 16 and the light 32, respectively. The power supply 36 can be any suitable power supply with sufficient capacity to power the aerator 16 and the light 32. In the preferred embodiment of the present invention, the power supply 36 is simply a standard electrical outlet connected to the electrical utility. A wide variety of other power supplies can be utilized in conjunction with the electrical devices of the present invention so as to carry out the purposes of the present invention. For example, a battery supply can be mounted within the base 12 so as to supply energy to the aerator 16 and the light 32, if desired.

As can be seen in FIG. 1, the container 20 is a pitcher with a handle 38 extending outwardly therefrom. The handle 38 has a bottom through which the influent port 22 opens. Also, as can be seen in FIG. 1, the receptacle area 14 in the base 12 has a slotted area extending radially outwardly therefrom. The effluent port 18 opens in this slotted area. The bottom of the handle 38 is removably received within this slotted area. A switch 40 is mounted in the base 12 so as to be cooperative with the bottom of the handle 38. The switch 40 is a button-actuated switch which, when depressed, actuates the aerator 16. As such, when the bottom of the handle 38 is placed into the slotted area of the receptacle area 14, the button of the switch 40 will be depressed so as to actuate the aerator 16. Also, when the switch 40 is actuated, the effluent port 18 will be received within the influent port 22 so that a sufficient supply of air can be delivered into the air delivery channel 24.

In FIG. 1, it can be seen that the pitcher 20 has a lid 42 affixed to a top thereof. A spout 44 extends outwardly from the top of the container 20 so that water within the container 20 can be easily poured therefrom. In normal use, the pitcher 20 will act like any other household pitcher whereby water can be dispensed therefrom in a convenient and easy manner.

Figure 2:
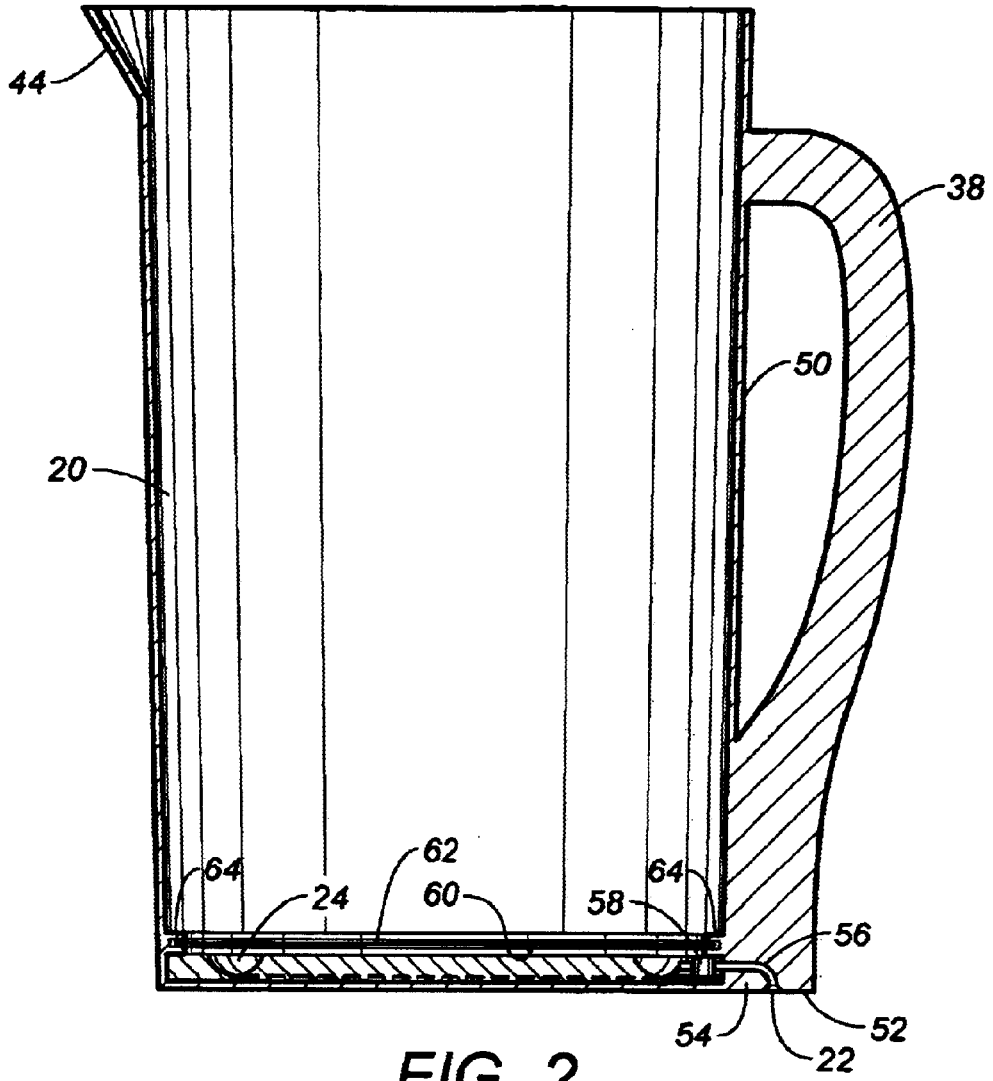
FIG. 2 is a cross-sectional side view of the container of the water aerator apparatus of the present invention.

Referring to FIG. 2, the configuration of the pitcher 20 is particularly illustrated. Importantly, in FIG. 2, the handle 38 is illustrated as extending outwardly of the wall 50 of the pitcher 20. The handle 38 has a flat bottom surface 52. The influent port 22 has a funnel-shaped opening at 52. Another portion 54 of the bottom of the handle 38 is also positioned so as to be cooperative with the switch 40 on the base. An air passageway 56 extends from the influent port 22 toward the air delivery channel 24. A check valve 58 is placed on the end of the air passageway 56 within the air delivery channel 24. Check valve 58 prevents liquid from flowing back through the air passageway 56 so as to be emitted from the influent port 22. Check valve 58 also allows a free flow of air therethrough. As such, the check valve 58 will prevent accidental leakage of liquid from the interior of the container 20.

As will be described hereinafter, the air delivery channel 24 has a generally U-shaped cross-section with an open top surface 60 facing upwardly in the container 20. A mesh screen 62 is positioned directly upon the open surface 60 of the air delivery channel 24. The mesh screen 62 is supported within the container 20 by a frame 64 extending around a periphery of the screen 62. The frame 64 is fixedly received within the wall 50 of the container 20. The mesh screen is positioned directly over the air delivery channel 24 so as to allow air passing therethrough to have a bubble size of approximately 50–100 microns. The screen 62 is suitably hydrophobic such air passes upwardly therethrough while water is prevented from passing downwardly therethrough. The screen 62 avoids problems associated with head pressure and allow an even distribution across the entire interior of the container 20. This will maximize the amount of dissolved oxygen within any liquid contained within the container 20.

Figure 3:
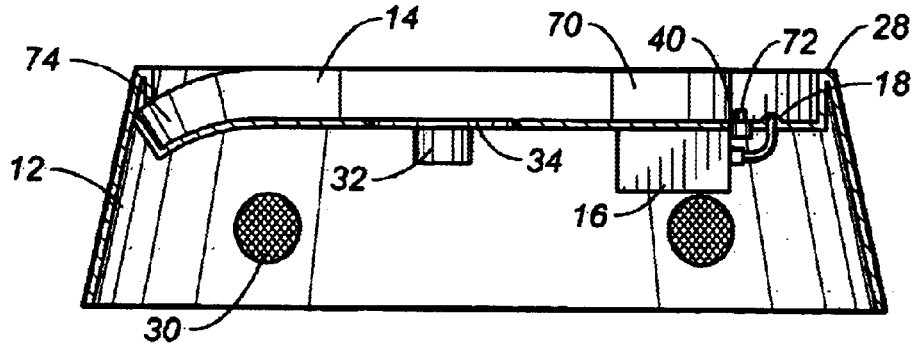
FIG. 3 is a cross-sectional side view showing the base of the water aerator apparatus of the present invention.

FIG. 3 shows the interior configuration of the base 12. In particular, in FIG. 3, the receptacle area 14 is illustrated as extending across the top 28 of the base 12. Light 32 is positioned generally centrally of the receptacle area 14. The aerator 16 is positioned within the base 12 generally adjacent to the slotted area 70 outwardly from the receptacle area 14. The effluent port 18 is illustrated as extending upwardly in the slotted area 70. Similarly, the switch 40 is illustrated as having button 72 extending upwardly in this slotted area. Slotted area 70, as stated previously, will receive the flat bottom 52 of the handle 38.

The receptacle area 14 includes a downwardly extending lip 74 opposite to the slotted area 70. This downwardly extending lip 74 will allow the pitcher 20 to be tilted therein so that liquid can be poured from the spout 44 while pitcher generally remains within the receptacle area 14.

FIG. 4 shows a plan view of the base 12. In FIG. 4, it can be seen that the walls 80 of the base have a generally frustoconical shape. The receptacle area 14 is illustrated as being generally circular. Slotted area 70 will extend radially outwardly from the periphery of the circular receptacle area 14. The effluent port 18 is illustrated as positioned within this slotted area 70. Similarly, the switch 40 is also positioned in the slotted area 70. Light 32 is positioned centrally of the circular receptacle area 14. FIG. 4 shows that the base 12 has a plurality of vents 30 formed in the walls 80 of the base 12. Vents 30 allow air to be passed through into the interior of the base 12 and to supply the aerator 16 with a requisite supply of air. Several vents 30 are employed in the present invention so as to avoid the possibility and the problems associated therewith if any of the vents 30 should accidentally be placed against an adjoining surface which would close the vents.

FIG. 5 shows the interior of the container 20 of the present invention. In particular, in FIG. 5, the air delivery channel 24 is illustrated as having a generally circular configuration extending around the bottom 82 of the container 20. The circular configuration of the air delivery channel 24 will communicate with the influent port 22 through the air passageway 56. Check valve 58 is illustrated as positioned within the air delivery channel 24 so as to block any liquids that might flow through the mesh screen 62 and outwardly of the influent port 22. Handle 38 is illustrated as extending outwardly from the periphery of the container 20. In that the mesh screen 62 (illustrated partially) extends around the inner wall of the container 20. In particular, a frame 64 is embedded against the inner wall 86 so as to securely affix the mesh screen 62 in its desired position. By extending entirely over the U-shaped air delivery channel 24, the mesh screen 62 avoids any head pressure problems.

FIG. 6 illustrates the relationship of the flat bottom surface 52 of the handle within the slotted area 70 of the base 12. In particular, effluent port 18 is illustrated in the form of a nozzle having an opening directed outwardly of the surface of the slotted area The button 58 of the switch 40 will extend outwardly of the surface of the slotted area 70. When the flat surface 52 is placed so as to be in surface-to-surface contact with the surface of the slotted area 70, inverted funnel-shaped opening of the influent port 22 will mate with the exterior surface of the nozzle of the effluent port 18. As a result, a secure sealing relationship is established between the influent port 22 and the effluent port 18. Air passageway 56 will deliver air to the air delivery channel. Air passageway 56 will allow air from the aerator to pass through the nozzle of the effluent port 18. Switch 40 is connected by electrical line 92 to the aerator such that when the button 88 is depressed, the switch 40 will send a signal to the aerator to activate the aerator and cause air to flow outwardly therefrom. When the button 88 is released, such as by the removal of the container 20 from the receptacle area 14, the switch 40 will transmit a signal to the aerator to stop the flow of air therefrom.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

It is claimed:

1. A water aerator apparatus comprising:

a base having a receptacle area formed therein;

an aerator having an effluent port opening from said base;

a container removably received within said receptacle area of said base, said container having an influent port opening at a bottom of said container, said influent port being cooperative with said effluent port; and an air delivery channel formed in an interior of said container, said air delivery channel communicating with said influent port such that air from said aerator passes into said air delivery channel through said effluent port and said influent port, said container being a pitcher with handle extending outwardly therefrom, said handle having a bottom, said influent port opening at said bottom of said handle, said receptacle area in said base having a slotted area extending regularly outwardly therefrom, said effluent port opening in said slotted area, said bottom of said handle being removably received in said slotted area.

2. The apparatus of claim 1, further comprising:

a screen means position directly over said air delivery channel, said screen means for passing air therethrough having a bubble size of approximately 50–100 microns.

3. The apparatus of claim 2, said screen means being hydrophobic such that air passes upwardly therethrough and water is prevented from passing downwardly therethrough.

4. The apparatus of claim 3, said screen means being a stainless steel mesh screen having a frame extending around a periphery thereof, said frame engaged with a wall of said container.

5. The apparatus of claim 4, said air delivery channel having a U-shaped cross-section with an open surface facing upwardly in said container, said mesh screen positioned directly upon said open surface of said delivery channel.

6. The apparatus of claim 1, said air delivery channel extending in a circular pattern adjacent a bottom of said container, said air delivery channel having a U-shaped cross-section with an open surface facing upwardly in said container.

7. The apparatus of claim 1, said influent port having a funnel-shaped opening formed at said bottom of said handle, said funnel-shaped opening being wide at said bottom of said handle, said influent port having an air passageway extending through said handle to said air delivery channel.

8. The apparatus of claim 7, said effluent port comprising a nozzle having an opening extending upwardly from said slotted area, said nozzle fitting into said funnel-shaped opening, said effluent port having an air passageway extending from said aerator.

9. The apparatus of claim 1, further comprising:

a switch means mounted in said slotted area, said switch means for activating said aerator when said pitcher is positioned in said receptacle area.

10. The apparatus of claim 9, said switch means being a button-activated switch which depresses when the bottom of said handle is placed upon the button of said switch, said switch being electrically connected to said aerator.

11. A water aerator apparatus comprising:

a base having a receptacle area formed therein;

an aerator having an effluent port opening from said base;

a container removably received within said receptacle area of said base, said container having an influent port opening at a bottom of said container, said influent port being cooperative with said effluent port;

an air delivery channel formed in an interior of said container, said air delivery channel communicating with said influent port such that air from said aerator passes into said air delivery channel through said effluent port and said influent port; and a light means affixed to said base generally centrally of said receptacle area, said light means for illuminating an interior of said container.

12. A water aerator apparatus comprising:

a base having a receptacle area formed therein;

an aerator having an effluent port opening from said base;

a container removably received within said receptacle area of said base, said container having an influent port opening at a bottom of said container, said influent port being cooperative with said effluent port; and an air delivery channel formed in an interior of said container, said air delivery channel communicating with said influent port such that air from said aerator passes into said air delivery channel through said effluent port and said influent port, said receptacle area comprising a circular area formed in a top surface of said base, said circular area having a size and shape corresponding to a size and shape of the bottom of said container, said circular area having a downwardly extending lip formed therefrom, said circular area having a radially outwardly extending slotted area, said lip being at an opposite side of said circular area from said slotted area.

13. The apparatus of claim 12, said base having a frustoconical shape with a wide diameter portion at a bottom thereof and a narrow diameter portion at a top thereof, said receptacle area formed in said top.

14. A water aerator apparatus comprising:

a base having a receptacle area formed therein;

an aerator having an effluent port opening from said base;

a container removably received within said receptacle area of said base, said container having an influent port opening at a bottom of said container, said influent port being cooperative with said effluent port; and an air delivery channel formed in an interior of said container, said air delivery channel communicating with said influent port such that air from said aerator passes into said air delivery channel through said effluent port and said influent port, said base having a vent formed in a wall thereof, said vent opening so as to allow air from an exterior of said base to pass to said aerator.

15. The apparatus of claim 9, further comprising:

a light affixed to said base generally centrally of said receptacle area, said switch means for actuating said when said pitcher is positioned in said receptacle area.

16. The apparatus of claim 1, further comprising:

a check valve means positioned between said effluent port and said air delivery channel, said check valve means for preventing liquid from passing into said influent port.

17. The apparatus of claim 1, further comprising:

a check valve means positioned between said effluent port and said aerator, said check valve means for preventing liquid from passing into said aerator from said effluent port.

* * * * *